United States Patent [19]

Czelusniak et al.

[11] Patent Number: 4,658,490

[45] Date of Patent: Apr. 21, 1987

[54] SIDING INSTALLATION TOOL

[76] Inventors: Daniel J. Czelusniak, 80 Loudville Rd., East Hampton, Mass. 01022; Robert J. Cooke, 456 Russellville Rd., Westfield, Mass. 01085; Donald K. Groleau, 18 Jonathan Judd Cir., Southampton, Mass. 01073

[21] Appl. No.: 767,787

[22] Filed: Aug. 20, 1985

[51] Int. Cl.[4] ..... B25B 27/14

[52] U.S. Cl. ..... 29/271; 29/283

[58] Field of Search ..... 29/270, 271, 283; 269/904, 3; 294/15, 81.5; 211/187; 248/243, 247

[56] References Cited

U.S. PATENT DOCUMENTS

| | | | |
|---|---|---|---|
| 2,710,735 | 6/1955 | Stollenwerk | 248/243 |
| 2,942,575 | 6/1960 | Boyd et al. | 294/81.5 |
| 3,631,821 | 1/1972 | Zachariou | 211/187 |
| 3,701,194 | 10/1972 | Widman | 29/283 |
| 3,942,779 | 3/1976 | Bourdo | 269/904 |
| 4,159,029 | 6/1979 | Matthews | 269/904 |

*Primary Examiner*—Robert C. Watson

[57] ABSTRACT

A flexible vinyl corner post is installed squarely on a corner of a building that is to be covered with vinyl siding through the use of a tool which permits a single person to hold the corner post in a true vertical position on the building and thereafter secure the corner post to the building before releasing the corner post from the tool.

2 Claims, 5 Drawing Figures

FIG. 1
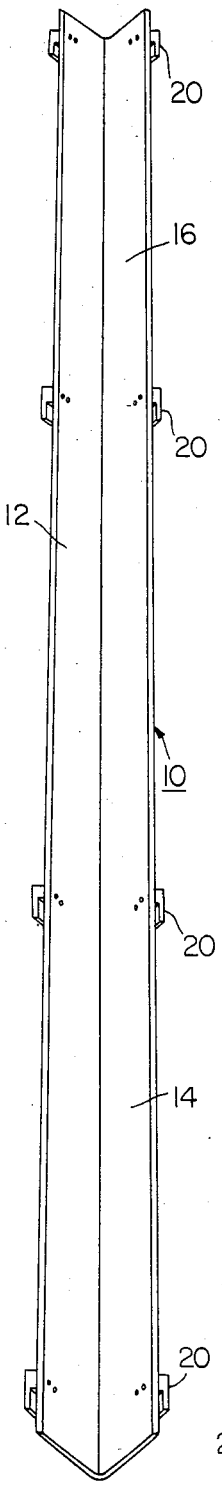
FIG. 2
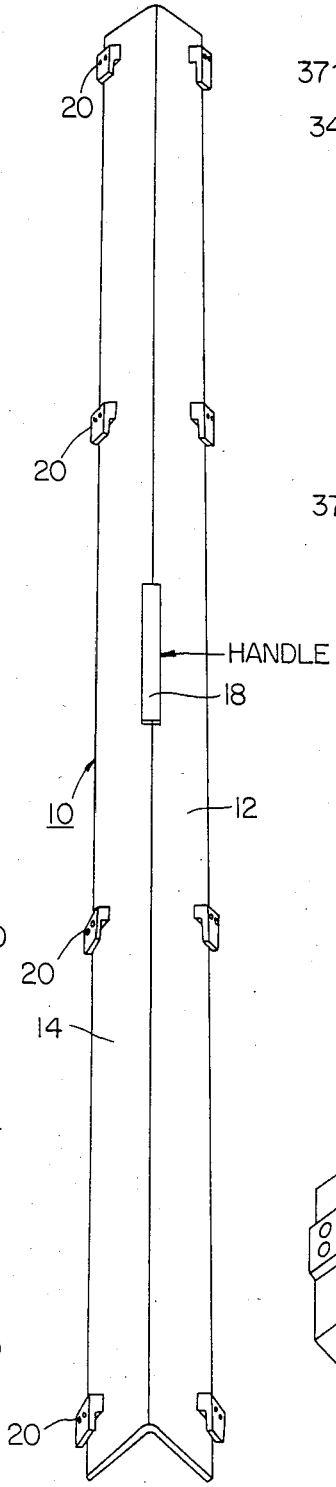
FIG. 3
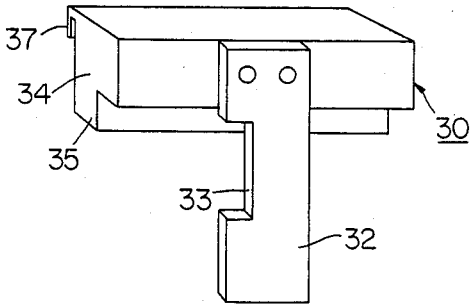
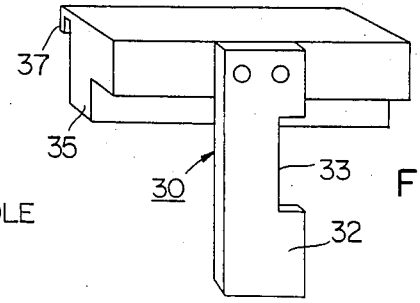
FIG. 4
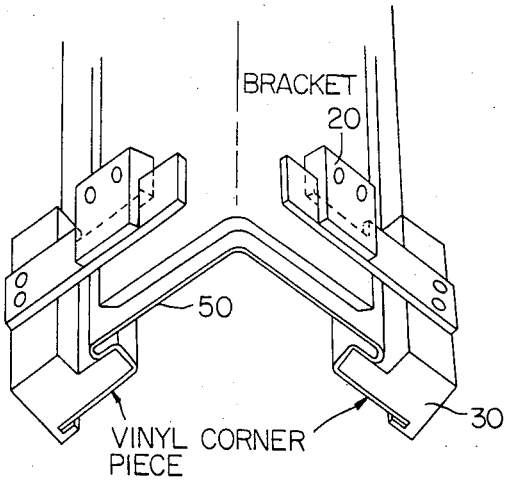
FIG. 5

SIDING INSTALLATION TOOL

BACKGROUND OF THE INVENTION

This invention relates to a siding installation tool, and more particularly to such a tool which is designed to hold a flexible corner post while the post is being secured to the building.

Siding a building with flexible vinyl siding is a highly competitive business in which the reputation of an installation contractor is often governed by the appearance of the work and by the cost of the installation. Vinyl siding is flexible and subject to twisting forces which make handling of lengthy sections by a single worker difficult and time-consuming.

Horizontal vinyl siding is secured to a building through the use of vertical corner posts which are constructed and arranged so as to hold and cover the ends of the horizontal clapboards. The appearance of the job requires that the corner posts by truly vertical before the horizontal clapboards are inserted into the slots which are formed in the corner posts. The expense of labor is such that the use of more than a single worker to install a corner post significantly reduces the profitability of a contractor. However, the flexibility of a vinyl corner post is such that two workers are often needed to ensure that the corner post is installed true and square.

SUMMARY OF THE INVENTION

It is an object of this invention to provide an installation tool which permits a single worker to install a corner post on a building in a truly vertical position. Another object of this invention is the provision of an installation tool that improves the appearance of a siding job and reduces the labor cost of the installation.

In accordance with this invention, a siding installation tool is provided which holds a vinyl corner post in a rigid condition for a single worker to secure the corner post to a building. The installation tool of this invention is basically a length of angle iron having holding blocks which hold a corner post firmly in the tool until such time as the corner post is secured to the building. The holding blocks serve to hold the corner post in the tool and against the corner of the building, so that there is no need for more than one worker to be involved in aligning the corner post to ensure that the corner post is vertical.

THE DRAWING

FIG. 1 is a top view of the installation tool of this invention from the open or concave side of the tool.

FIG. 2 is a top view of the tool of FIG. 1 from the closed or convex side of the tool.

FIG. 3 is a perspective of a holding block which mates with a locking bar on one side edge of the tool of FIGS. 1 and 2.

FIG. 4 is a perspective of a holding block which mates with a locking bar on the other side edge of the tool of FIGS. 1 and 2.

FIG. 5 is a perspective of a broken-away length of the tool of FIGS. 1 and 2 with a vinyl corner post held in the tool by the holding blocks of FIGS. 3 and 4.

DETAILED DESCRIPTION

FIGS. 1 and 2 show a siding installation tool 10 comprising a length of rigid angle iron having wing members 12 and 14 which join at a right angle to provide a concave trough 16. Tool 10 is preferably made of aluminum for lightness and durability. Other suitable materials for tool 10 include plastics and wood, so long as structural integrity is maintained throughout the full length of the tool, such that twisting and warping of the tool is prevented. It is preferred that wings 12 and 14 are each 3 inches wide and $\frac{1}{4}$ inch thick in the case of aluminum.

Tool 10 is preferably 8 feet long so as to carry a full 8 foot corner vinyl post without any overhang which could become bent or damaged during handling. Again the lightness of an aluminum tool permits protection of a corner post over its full length while still enabling a single worker to hold the loaded tool against the corner of a building and secure the vinyl corner post without assistance in aligning the corner post in the true vertical. A handle 18 is provided on the convex side of tool 10 about mid-way along the length of the tool to facilitate easy handling of the tool and a corner post by a single worker.

A plurality of L-shaped holding blocks 20 are affixed to wings 12 and 14 along the edges thereof. The number of blocks 20 need only be sufficient to hold a vinyl corner post tightly against the tool over the full length of the corner post. It has been found that eight blocks arranged symmetrically over the 8 foot length of tool 10 ensures proper alignment of a vinyl corner post in the tool. Blocks 20 are also preferably of $\frac{1}{4}$ inch aluminum stock so as to maintain dimensional stability and provide long life in the wear-and-tear environment of a construction site.

FIGS. 3 and 4 show retainer assembly 30 having a locking bar portion 32 joined to a contact portion 34. Bar portion 32 is provided with a notched or cut-out 33 which is dimensioned so as to mate with the width of L-shaped block 20. Cut-out 33 is either right-handed or left-handed, depending upon which side of tool 10 is to be engaged. Contact portion 34 is shaped with a depending leg 35 which is designed to fit into the conventional slot found in vinyl corner posts. Contact portion 34 also has a groove 37 which accepts and holds the edge of a corner post. Contact portion 34 is preferably of a plastic material, e.g. Teflon, which is easily machined to proper shape and which provides a slippery surface that makes easy the application of retainer assembly 30 to and removal from a vinyl corner post.

FIG. 5 shows a vinyl corner post 50 secured in the inner concave side of tool 10 by holding blocks 20 and retainer assemblies 30. Contact portion 34 is positioned on corner post 50 with leg 35 engaged in the slot in the corner post and the edge of the corner post is positioned in groove 37.

Corner post 50 is placed in tool 10 and retainer assemblies 30 are slid along the edges of the corner post until locking bar portions 32 engage with blocks 20. The dimensions of notches 33 and blocks 20 are such that a tight, but easily released, engagement is attained by the worker using one hand while holding tool 10 by handle 18 with his/her other hand.

Corner post 50 held in tool 10 is held by a worker against the corner of a building. The worker holds tool 10 by handle 18 while he/she secures post 50 to the building, e.g. with a nailing gun by driving nails along the edges of the corner post between the holding blocks 20. After the corner post is nailed to the building, the retainer assemblies 30 are disengaged from blocks 20 by sliding the assemblies along the corner post away from the closed ends of blocks 20. The assemblies 30 slide laterally out of engagement with the corner post once notches 33 are free of blocks 20.

What is claimed is:

1. A siding installation tool comprising a rigid and elongated angle iron having a pair of wing members forming a right angle, a plurality of holding blocks affixed to both wing members of said angle iron, a plurality of retainer assemblies having locking positions and contact portions, said locking portions releasably engagable with said holding blocks, said assemblies and said holding blocks adapted to hold a siding corner post in said angle iron by leg and groove means on said contact portions dimensioned for engaging slots and edges conventionally found in such a siding corner post.

2. The tool of claim 1 wherein said siding corner post is held against the inner concave side of said angle iron, said blocks are affixed to the outer convex side of said angle iron, said retainer assemblies are slidably engagable with said blocks, and said contact portions include a slippery surface to facilitate engaging said slots and edges.

* * * * *